US011154880B2

(12) United States Patent
Duffin et al.

(10) Patent No.: US 11,154,880 B2
(45) Date of Patent: Oct. 26, 2021

(54) NUTATING SPRINKLER HEAD

(71) Applicant: XCAD VALVE & IRRIGATION, INC., Paul, ID (US)

(72) Inventors: Don Duffin, Paul, ID (US); Roger Duffin, Paul, ID (US); Casey Nutt, Paul, ID (US)

(73) Assignee: XCAD VALVE AND IRDIGATION, INC., Paul, ID (US)

( * ) Notice: Subject to any disclaimer, the term of this patent is extended or adjusted under 35 U.S.C. 154(b) by 12 days.

(21) Appl. No.: 17/116,710

(22) Filed: Dec. 9, 2020

(65) Prior Publication Data

US 2021/0187524 A1 Jun. 24, 2021

Related U.S. Application Data

(60) Provisional application No. 62/952,034, filed on Dec. 20, 2019.

(51) Int. Cl.
*B05B 3/00* (2006.01)

(52) U.S. Cl.
CPC ..... *B05B 3/008* (2013.01)

(58) Field of Classification Search
CPC ..... B05B 3/008; B05B 3/0486; B05B 3/0445; B05B 3/0463; B05B 3/0422; B05B 3/0427
See application file for complete search history.

(56) References Cited

U.S. PATENT DOCUMENTS 9,457,363 B2 * 10/2016 Duffin ..... B05B 3/008
2019/0336991 A1 * 11/2019 Duffin ..... B05B 3/008

* cited by examiner

*Primary Examiner* — Steven M Cernoch
(74) *Attorney, Agent, or Firm* — Scott D. Swanson; Shaver & Swanson

(57) ABSTRACT

A sprinkler head is disclosed having a fluid distribution cage configured to nutate between an upper sprinkler body plate and a lower sprinkler body plate. The sprinkler head has a projection to cause the fluid distribution cage to hang at a non-horizontal angle prior to initiation of nutation. The projection is configured to move or rotate away from the upper cage plate of the fluid distribution cage during nutation initiation. Preferably the projection is positioned on a gimbal ring that rotates in response to force asserted on the projection by the upper cage plate. Preferably the gimbal ring has two projections positioned on opposing sides of the axis of rotation of the gimbal ring.

11 Claims, 11 Drawing Sheets

NUTATING SPRINKLER HEAD

TECHNICAL FIELD

The herein disclosed and claimed inventive concepts generally relate to a sprinkler head, and more particularly to a nutating sprinkler head for randomizing fluid distribution.

BACKGROUND

Irrigation systems such as center pivot systems have a structure from which down tube are suspended, with sprinkler heads attached to the down tubes. The sprinkler heads take a number of different forms and all try to create a uniform and random spread of fluid droplets, or a size which does not result in excessive evaporation. The sprinkling heads may also be mounted on top of the rotating structures of the center pivot systems, or on upward turned ends of the down tubes. Such sprinkler heads can often operate in any orientation, because the force of the fluid stream is greater than the force of gravity on the lightweight sprinkler parts. However, for convenience the sprinkler head and its parts are described as being in the orientation as shown in the figures, with "upper", "lower", "top", and "bottom" surfaces applied to the sprinkler parts in the orientation shown in the figures.

A variety of prior attempts at improving sprinkler heads have been utilized. One such attempt includes the use of nutation of a fluid distribution cage about a disk. Fluid is sprayed on a distributor disk positioned at a first end of the fluid distribution cage. The fluid spray causes nutation of the cage typically about a disk positioned within the sprinkler head. Nutation is a motion of the fluid distributing cage in rotating and tilting simultaneously, in a manner similar to a coin which is placed on its side and spun—at the end of the coin's spinning, it is rotating slowly, while rocking side to side, or nutating.

The nutation of the distribution cage and disk causes the spray of fluid to be distributed randomly to the area to be whetted. An issue with nutating sprinklers has been how to initiate the nutation. If the distribution cage and disk hang horizontally on the sprinkler head disk, fluid spray can cause the distribution cage and disk to hang up and not nutate. Attempts to initiate nutation have included using structure such that the distribution cage and disk hang at an angle from the sprinkler head disk. However, this structure can further interfere with the initial nutation if the rotating distribution cage contacts the structure before full nutation is accomplished. Accordingly what is needed is a sprinkler head with increased functionality to initiate nutation.

SUMMARY OF THE DISCLOSURE

Accordingly, what is disclosed is a fluid distributing sprinkler head. The sprinkler head has a sprinkler body which partially encloses a fluid delivery tube with an attached fluid nozzle. Fluid flows through the sprinkler body upper ring and exits out the fluid nozzle. The fluid nozzle constricts the fluid stream to form a narrower stream of fluid that is sprayed on a distribution disk.

The sprinkler body upper ring preferably is attached to or integral with a weight for stabilizing the sprinkler head during use. The fluid delivery tube is attached at a first end to the sprinkler body upper ring and extends away from the sprinkler body upper ring. The fluid delivery tube can be removably attached (such as by threads) to the sprinkler body upper ring, welded to the upper sprinkler body upper ring, or otherwise fixedly attached to the sprinkler body upper ring. The fluid delivery tube is hollow and configured such that fluid is sprayed through the fluid delivery tube from the nozzle. The fluid delivery tube is attached at a second end to a sprinkler body lower ring. A fluid distribution cage, also called a diffuser, is rotatably positioned on the fluid delivery tube between the sprinkler body lower ring and the sprinkler body upper ring. The fluid distribution cage has an upper cage plate and a lower cage plate. The lower cage plate and upper cage plate are attached in a spaced apart relationship by one or more cage arms. The lower cage plate has an upper surface configured to distribute fluid sprayed onto the lower cage plate. The upper cage plate is freely attached to the fluid delivery tube between the upper sprinkler body ring and the lower sprinkler body ring. The fluid distribution cage is configured to nutate about the sprinkler body lower ring when fluid is sprayed from the nozzle onto the upper surface of the lower cage plate.

In a preferred embodiment the sprinkler body upper ring defines an upper race that limits nutation of the distribution diffuser about the sprinkler head. In a preferred embodiment the distribution diffuser has a tire, preferably made of a durable material that is configured to meet the upper race when the distribution diffuse is nutating about the sprinkler body lower ring. In a preferred embodiment the sprinkler body lower ring defines a lower race that limits nutation about of the distribution diffuser about the sprinkler head. Alternatively or additionally each race can comprise a tire configured to resist wear from the nutation of the diffuser cage.

The sprinkler body upper ring and sprinkler body lower ring are generally ring shaped for the passage of the fluid delivery tube (also called the fluid delivery tube) to pass through. Each of the sprinkler body upper ring and lower ring have a first side and a second side, which correspond to an upper side, and a lower side, as the sprinkler head is shown in the figures. In an embodiment the sprinkler body upper ring and lower ring are each fixedly attached to the fluid delivery tube. In another embodiment the fluid delivery tube is threaded at both ends for attachment to the sprinkler body upper ring and lower ring. Threaded attachment allows for interchangeability of the fluid delivery cage, discussed below, as well as for repair of the sprinkler head in the event that one or more pieces breaks or malfunctions.

The fluid distribution cage is made up of a lower cage plate with a first and second side, and an upper cage plate with a first and second side. The upper cage plate can also be called the swash plate. The two cage plates are generally coplanar and held in a spaced apart relationship by one or more cage arms. The upper cage plate is positioned between the sprinkler body upper ring and lower ring, and there is sufficient room between the sprinkler body upper ring and lower ring for the upper cage plate to rock back and forth (also called to nutate), as well as to rotate around the stationary sprinkler body upper ring and lower ring. The upper cage plate can be a circular ring shape, trilobal, or any other shape that will function to nutate between the sprinkler body upper ring and lower ring. The term "ring" used in conjunction with the upper sprinkler body ring and lower sprinkler body ring denotes that the lower side of the upper sprinkler body ring and the upper side of the lower sprinkler body ring are generally formed to allow for the nutating of the upper cage plate between the two surfaces. The upper side of the upper sprinkler body plate and the lower side of the lower sprinkler body ring can be in a variety of shapes that allow for the function of the sprinkler.

The sprinkler head can include one or more resilient cushions (also called a tire) on the upper cage plate or alternatively or additionally on the race of the sprinkler body defined by the sprinkler body upper ring and lower ring and/or on the upper cage plate. These can be rubber or rubber like material affixed or attached to the surfaces of the sprinkler body upper ring second (lower) side and the sprinkler body lower ring first (top) side. The resilient cushions are placed on the upper cage plate to interact with races located on the upper sprinkler body ring and the lower sprinkler body ring. The cushions serve to increase the friction between sprinkler body ring and the upper cage plate, so the upper cage plate nutates rather than spins on the sprinkler body. The cushions further provide a dampening effect and reduction of wear between said sprinkler body rings and the upper cage plate surfaces.

The sprinkler head is configured with at least one projection that is positioned on or within the lower sprinkler body ring. The projection is positioned and configured such that when the sprinkler head is off (and no fluid is being sprayed through the sprinkler head), the fluid distribution cage rests on the projection such that the fluid distribution cage rests at an angle relative to the upper and lower sprinkler body rings. The sprinkler body is configured such that when the sprinkler head turns on and nutation is initiating, the force of the upper cage plate beginning nutation causes the projection to move downward and out of the way of the nutating cage plate.

In a preferred embodiment the sprinkler head has a gimbal ring positioned within the lower sprinkler body ring to provide for the movement of the projections out of the way of the upper cage plate during initiation of nutation. Preferably the gimbal ring has two projections (or starter bumps) positioned on the gimbal ring. The gimbal ring has an axis of rotation about which the gimbal rotates when the upper cage plate impacts either of the projections when nutation is initiating. The two projections are positioned on opposing sides of the axis of rotation. When nutation has initiated to the point that the upper cage plate will not contact either projection, the gimbal ring returns to its resting position.

In one embodiment, the gimbal ring preferably has two bearings at opposing location on the circumference of the gimbal. The bearings are positioned within two races of an inner circumference of the sprinkler body lower ring. The gimbal ring can be removably positioned within the sprinkler body lower ring. When assembled, this aspect of the embodiment is referred to herein as the gimbal and sprinkler body lower ring assembly. The gimbal ring is configured such that when the sprinkler head is in a vertical (or standard) position and fluid is not flowing through the sprinkler head, the upper cage plate rests on the starting bumps of the gimbal in a non-horizontal position. When fluid is sprayed through the nozzle and onto the diffuser plate, the upper cage plate begins nutating about the lower sprinkler body ring. The initial nutation causes the upper cage plate to contact a starting bump of the gimbal ring. This contact causes the gimbal ring to rotate or rock about its bearings within the sprinkler body lower ring. Rotation of the gimbal causes the starting bumps to rotate out of the path of nutation of the upper cage plate. This allows the upper cage plate and fluid distribution cage to reach full nutation. The gimbal ring can include at least one tab extending from a bottom side of the gimbal ring. The tab is configured to restrain the gimbal ring from rising up and out of the bearing bosses. In a preferred embodiment the tab is a hooked tab that is configured to snap through openings in the sprinkler body lower ring.

The projections on the gimbal ring are preferably positioned apart on the gimbal ring. The projections serve to destabilize the fluid distributing cage, and to allow for the initiation of nutation. The fluid distribution cage has a generally circular lower cage plate having a first (top) side which has a generally peaked or pointed surface profile (also called a beveled surface), preferably with an upturned edge at the periphery of the lower cage plate. The lower cage plate can be called the strike plate. The upper surface of the lower cage plate is incised by spirally radiating grooves which radiate from a central raised point in the center. The raised point in the center of the preferably has a beveled top surface. This is so that when it is first struck by a stream of fluid, and fluid will deflect the lower cage plate to one side, a motion caused by the bevel. Once the lower cage plate is deflected to one side by the initial impact of fluid, the fluid stream then strikes the radiating groove on the lower cage plate, which initiates the spiral motion or nutation. The projections on the lower sprinkler body ring facilitate this initiation of motion, by keeping the cage from stabilizing when struck by the fluid stream.

Alternatively the gimbal ring is attached to a gimbal support ring by a pair of opposing bridges. The gimbal ring preferably has two opposing projections. Contact by said upper cage plate during nutation initiation causes said gimbal ring to rotate about an axis defined by the pair of opposing bridges. The bridges are configured to flex to allow rotation of the gimbal ring, and to return the ring to the starting position when nutation has proceeded past nutation.

The fluid distribution cage hangs freely on the one or more raised projections on the gimbal ring when fluid is not flowing through the sprinkler head and the sprinkler head is in a vertical position, with the bevel on the lower cage plate provided for deflecting the lower cage plate by an initial jet of fluid from the fluid directing tube. These structures plus the spirally radiating grooves serve to initiate a nutating motion in said fluid distribution cage after the initial deflection by the force of fluid.

The sprinkler head can have as an optional a weight, with the purpose of the weight being to dampen the vibrations caused nutation and help prevent wind from blowing the sprinklers away from vertical when they are hung over the crop on rubber hose.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

DETAILED DESCRIPTION OF THE EXEMPLARY EMBODIMENTS

Figure 1:
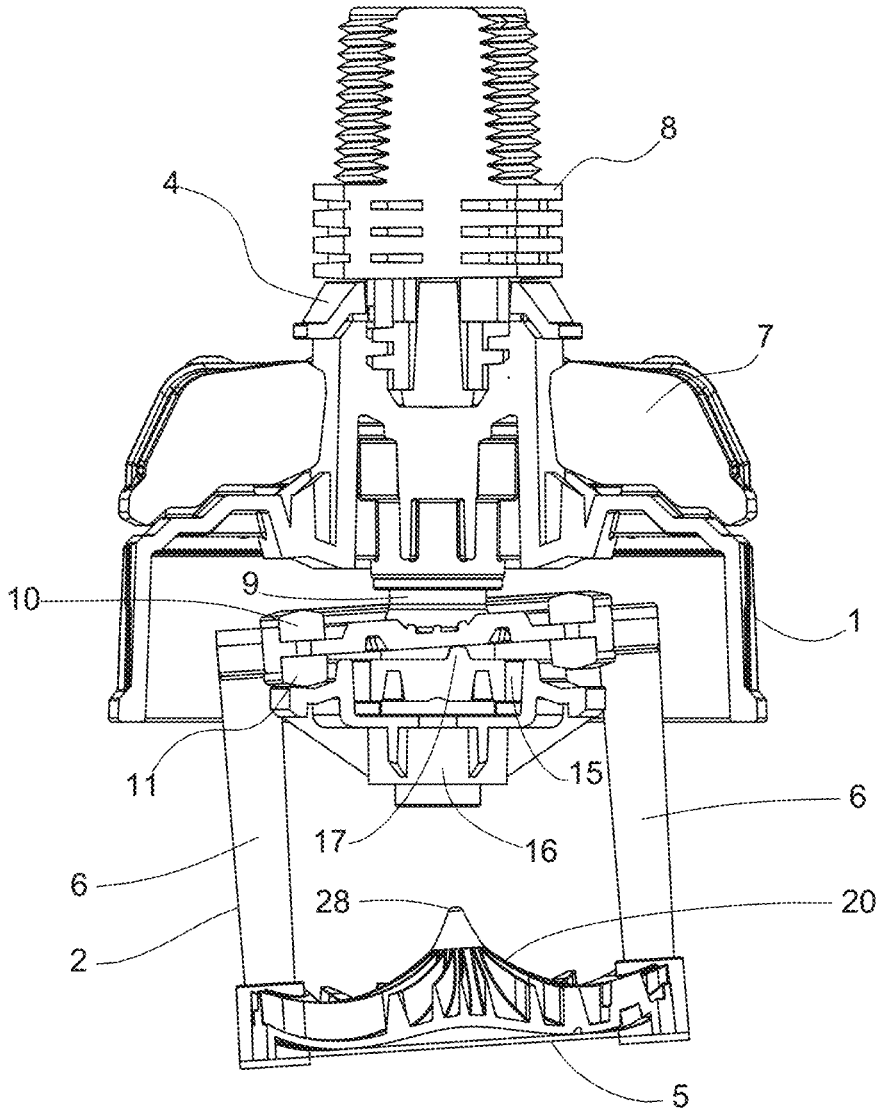
FIG. 1 is a cross sectional view of a first embodiment of a sprinkler head in an initial position.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

A first embodiment of the disclosed technology is shown in FIGS. 1-7. FIGS. 1-7 utilize a gimbal ring and lower sprinkler body ring assembly in which the gimbal ring is configured to rotate via two opposing bearings positioned within opposing bosses located on an inner surface of the lower sprinkler body ring. A second embodiment of the disclosed technology is shown in FIGS. 8-11. FIGS. 8-11 illustrate a gimbal ring assembly that utilizes a gimbal ring connected to a gimbal mounting ring by two opposing bridges which provide an axis of rotation of the gimbal ring relative to the gimbal mounting ring. In each embodiment pressure applied by the lower surface of the upper cage plate onto one of the opposing projections causes the gimbal ring to rotate downward and away from the upper cage plate.

Each of the depicted embodiments illustrates a sprinkler head having an upper sprinkler body 1 and a lower sprinkler body ring 16 attached in a spaced apart relationship to a fluid delivery tube 9. A fluid distribution cage 2 is loosely positioned on the fluid delivery tube and configured to hang from the lower sprinkler body ring when the sprinkler head is in the off position. Each of the depicted embodiments has two opposing projections positioned on a gimbal ring. As discussed below the configuration and operation of the gimbal ring varies between the embodiments depicted in FIGS. 1-7 and 8-11.

In each of the depicted embodiments, water (or other liquid) enters the irrigation system from an external source via inflow tube 8. Water flows from the input tube through a constricting fluid nozzle the upper sprinkler body ring and out of the upper sprinkler body ring through fluid delivery tube 9. In a preferred embodiment the fluid input nozzle can be removed to allow for replacement of the fluid restricting nozzle. The fluid sprayed through the fluid delivery tube strikes a beveled surface 20 of the lower cage plate 5 of the fluid distribution cage 2. which has an upper cage plate 18 (also called a swash plate or ring) and a lower cage plate 5. Each of the cage plates has an upper or first surface and a lower or second surface. The upper and lower cage plates are connected to each other and held in a spaced apart relationship by one or more cage arms 6. The depicted embodiments are shown with three cage arms.

Fluid sprayed from the constricting nozzle through the fluid delivery tube 9 hits the upper surface of the lower cage plate 5 at the peak 28 of the lower cage plate 5. The peak preferably has a beveled top surface, which is positioned to cause the cage deflect to one side when first struck by a stream of fluid. The bevel is aligned perpendicular to the raised projections on the underside of the swash plate. The lower cage plate 5 includes a number of spirally radiating grooves 22 emanating from the peak that distribute fluid sprayed from the sprinkler body in an irrigation pattern. The depicted embodiment of the lower cage plate 5 has an upturned edge 24 around the periphery of the plate that further serves to direct fluid being distributed. A stream of fluid sprayed on the peak from the fluid distribution tube causes the cage to begin nutating around the fluid distribution tube. As the fluid stream continues, the cage nutates around the fluid distribution tube altering the angle and location on the cage that the fluid stream hits, thus continuously altering the fluid pattern distributed from the sprinkler head.

In each of the embodiments the sprinkler head in what is called a vertical orientation at rest (without fluid flowing through the sprinkler head) such that the fluid distribution cage 2 is resting in a tilted orientation on two projections formed in the gimbal ring 15.

Each of the depicted embodiments illustrates two projections 17 positioned on the top surface of a gimbal ring to cause the fluid distribution cage to hang at an angle relative to the sprinkler body 15 and fluid delivery tube when the sprinkler is off (or not running). The projections or bumps allow for the initiation of nutation when fluid is initially sprayed onto the fluid distribution cage.

FIGS. 1-11 illustrate the projections being positioned on a gimbal ring of a gimbal ring and lower sprinkler body ring assembly.

Figure 2:
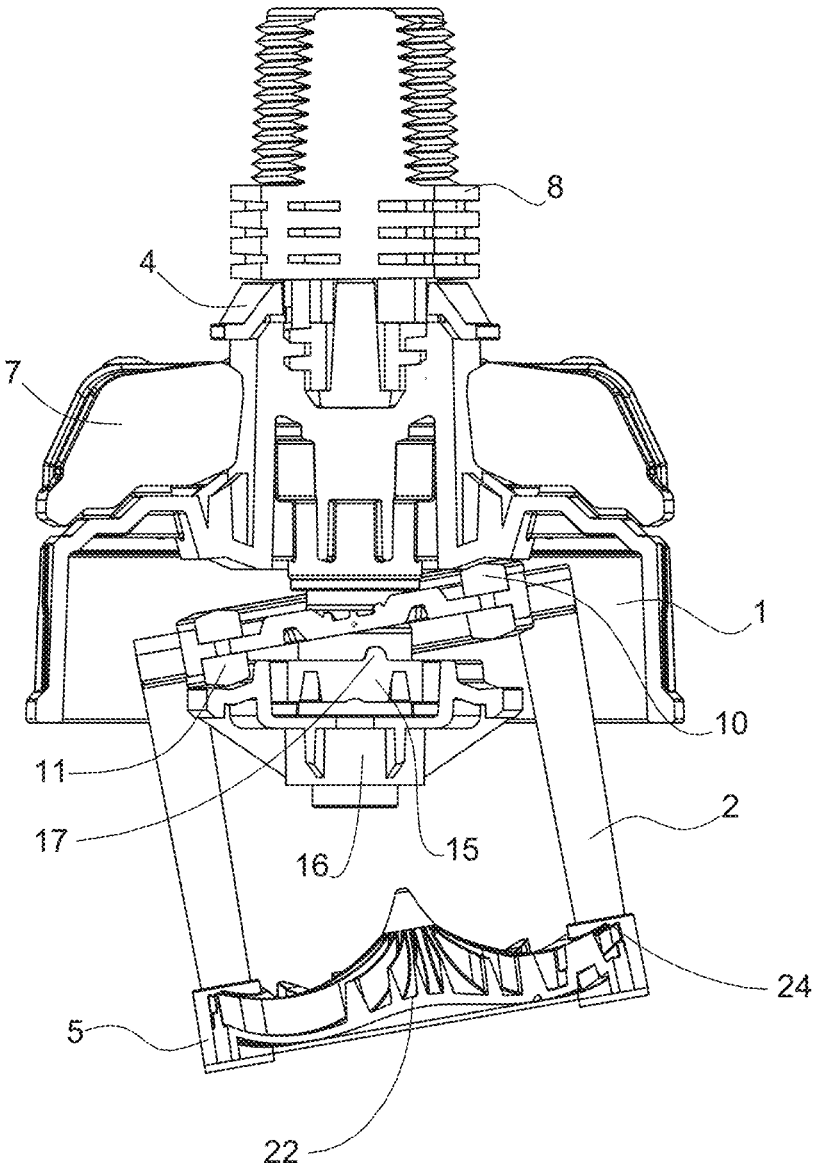
FIG. 2 is a cross sectional view of a first embodiment of a sprinkler head in a second position after fluid has begun spraying through the nozzle of the sprinkler head.

FIG. 2 shows a cross sectional view of the sprinkler head of FIG. 1 after fluid has been sprayed from the nozzle onto the fluid distribution plate. The distribution cage has begun nutation but has not reached full nutation. The sprinkler body lower ring 16. The gimbal ring has opposing gimbal axles that are positioned within bearing bosses on an interior surface of the lower plate (illustrated in FIG. 6).

A weight 7 is shown in the depicted embodiments. The optional weight is utilized to dampen the vibrations caused by the nutation and help prevent wind from blowing the sprinklers away from vertical when they are hung over the crop on hose. Alternatively the weight can be integral with the sprinkler body.

Figure 3:
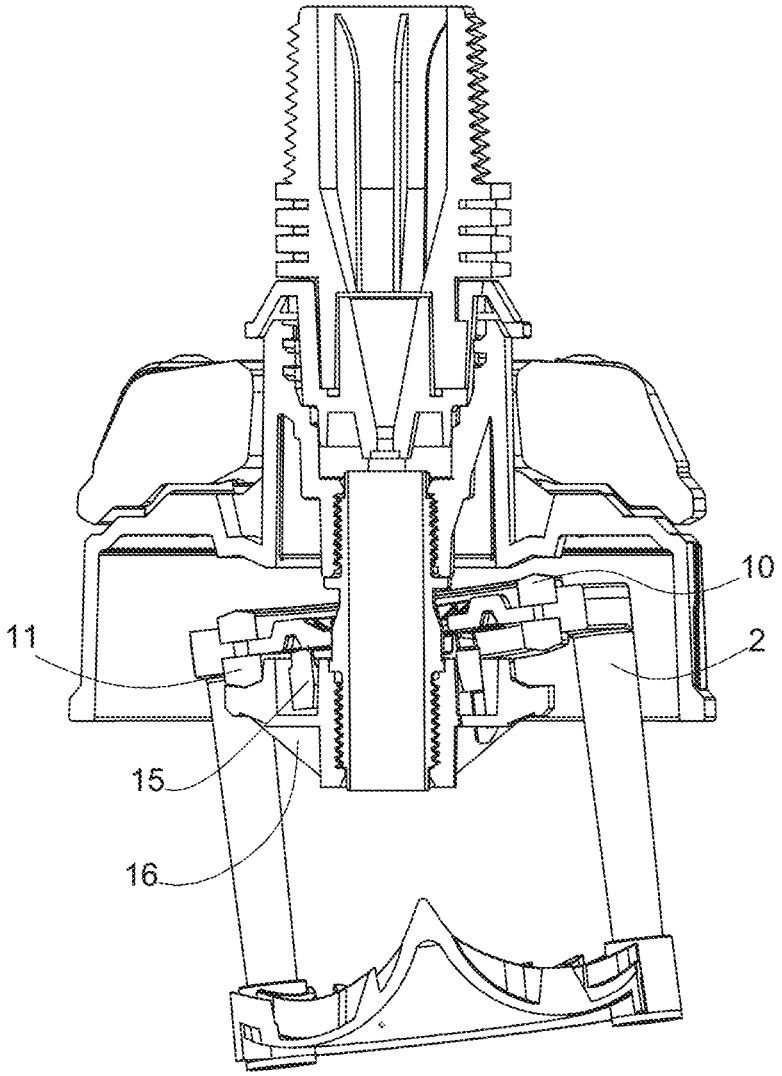
FIG. 3 is a cross sectional view of a first embodiment of a sprinkler head in a third position after fluid has begun spraying through the nozzle of the sprinkler head.

FIG. 3 illustrates the sprinkler head at a point in which the upper cage plate has contacted the projections on the upper surface of the gimbal ring. The gimbal has rotated on its bearings in the races in response to the contact from the upper cage plate. The rotation of the gimbal allows for the continued nutation of the distribution cage to reach full, continued nutation.

Figure 4:
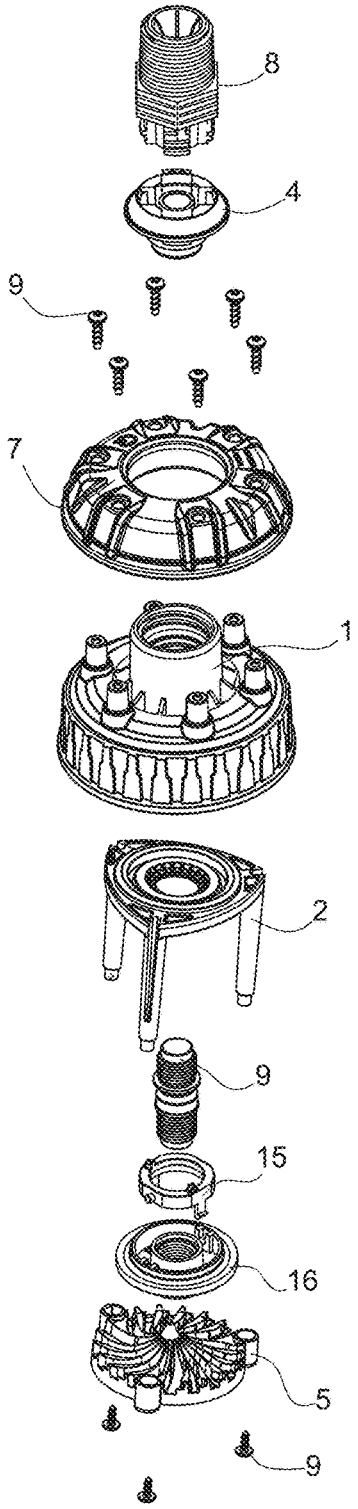
FIG. 4 is an exploded view of a first embodiment of a sprinkler head.

FIG. 4 illustrates an exploded view of the illustrated sprinkler head. The fluid delivery tube can be provided as shown to be a unitary piece with the lower sprinkler body plate. The fluid delivery tube and plate can be manufactured as a single piece or alternatively welded, glued or otherwise connected to provide a single piece. Similarly the fluid delivery tube can be integral with the upper sprinkler body plate. Alternatively the fluid deliver tube can be provided as a separate piece from the upper sprinkler body plate and the lower sprinkler body plate as shown in the depicted embodiments. The depicted fluid delivery tube is configured to threadingly attach to the sprinkler body 1 and lower sprinkler plate 16.

Figure 5:
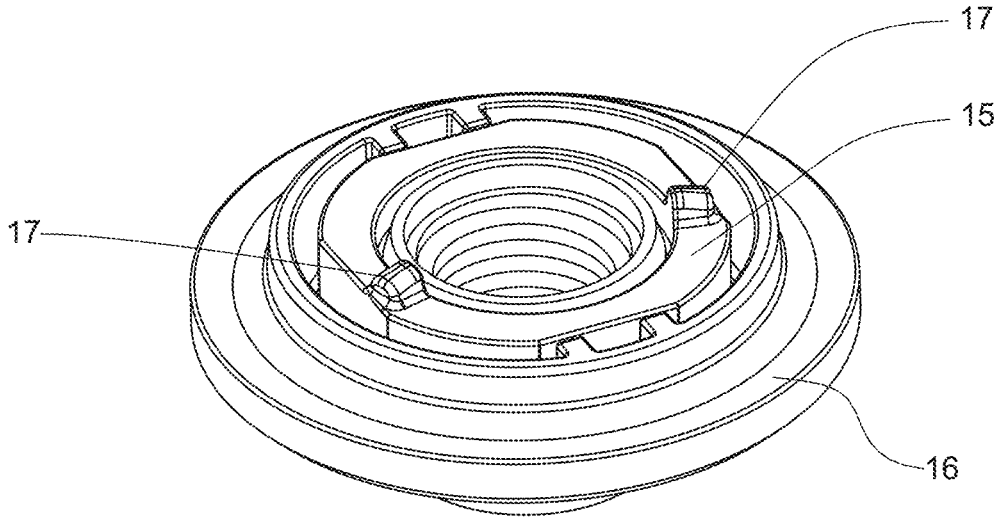
FIG. 5 is a perspective view of a gimbal and sprinkler body lower ring assembly.

FIG. 5 is a perspective view of the gimbal and sprinkler body lower ring assembly. The gimbal ring 15 is positioned within the lower sprinkler plate or ring 16 and configured to rock or rotate on the gimbal axles in response to the distribution cage contacting the projections 17 during initiation of nutation.

Figure 6:
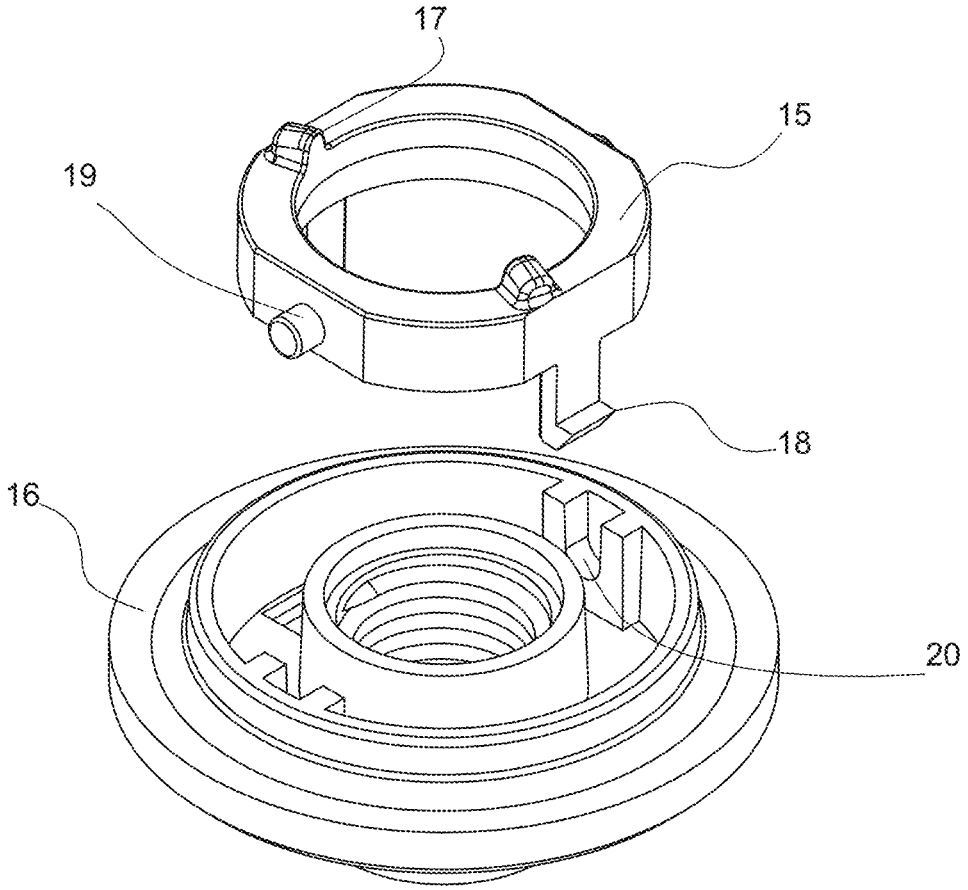
FIG. 6 is a perspective exploded view of a gimbal and sprinkler body lower ring assembly

FIG. 6 illustrates an exploded of view the gimbal and sprinkler body lower ring assembly having the gimbal ring 15 separate from the sprinkler body lower ring 16. The depicted gimbal is equipped with two tabs 18 that are configured to interact with the lower sprinkler plate.

Figure 7:
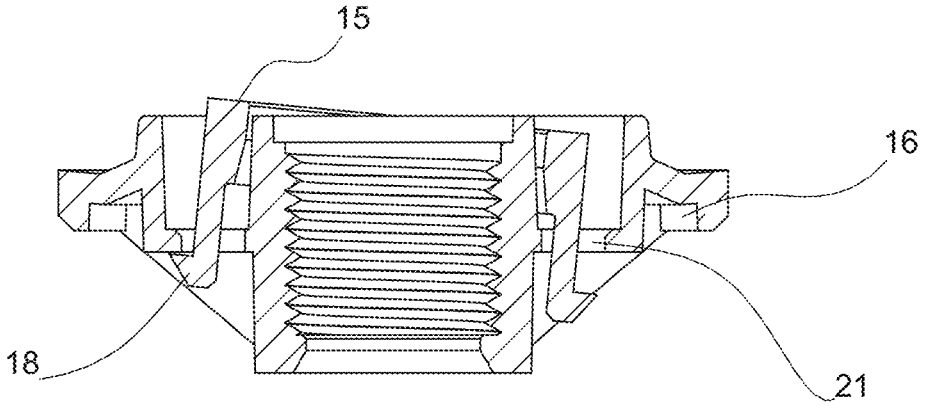
FIG. 7 is a cross sectional view of a gimbal and sprinkler body lower ring assembly.

FIG. 7 is a cross sectional view of the gimbal and sprinkler body lower ring assembly depicting the rocking or rotation of the gimbal ring relative to the sprinkler body lower ring. The rocking of the gimbal is constrained by the tabs 18 interacting with a lip 21 defining an inner opening of the sprinkler body lower ring. The gimbal ring has rotated from contact from the distribution cage on the projections on the upper surface of the gimbal ring. The distribution cage continues nutation in response to fluid spraying on the cage and once it reaches an angle of nutation sufficient to avoid the projections on the gimbal ring, the gimbal ring rotates back to its horizontal position.

Figure 8:
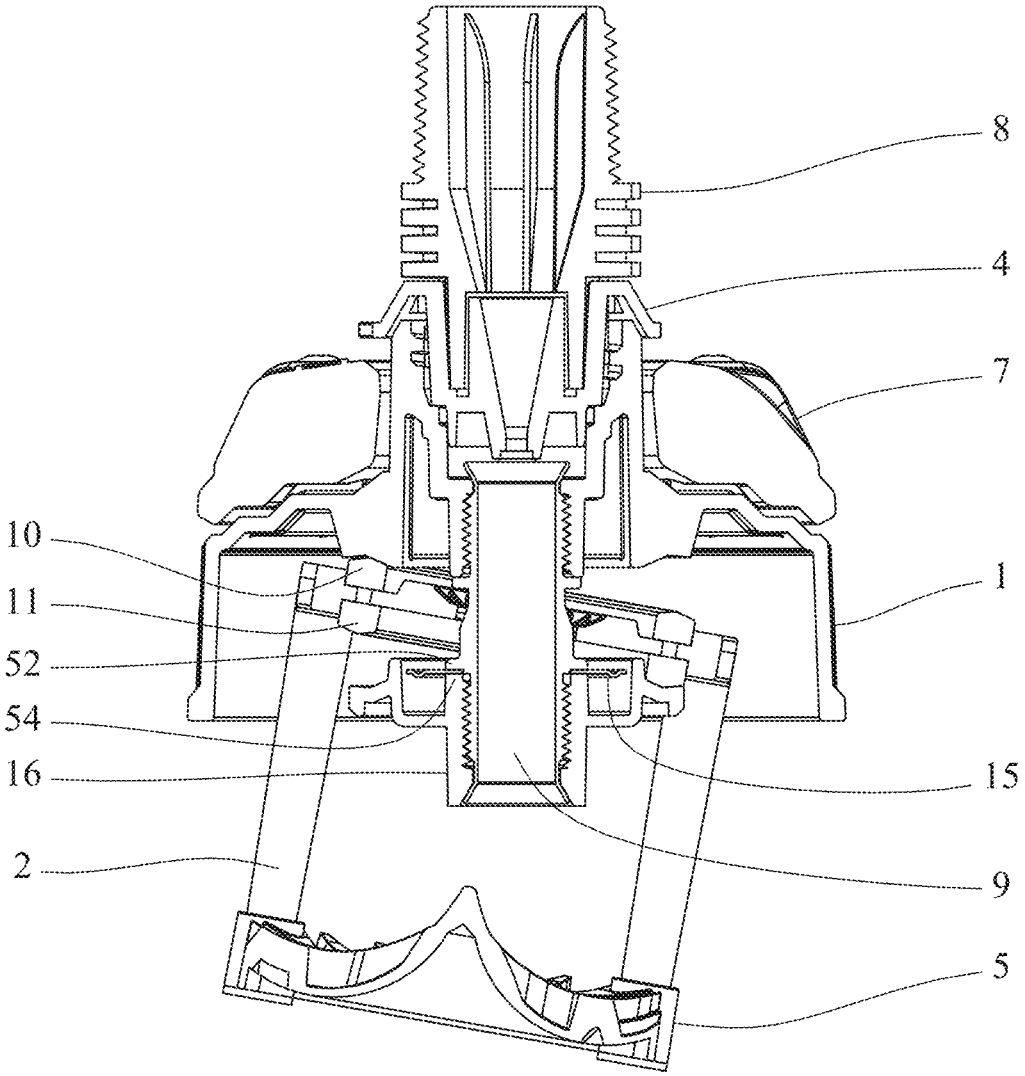
FIG. 8 is a cross sectional view of a second embodiment of a sprinkler head.

FIG. 8 illustrates a cross sectional view of the second embodiment of the sprinkler head. The depicted second embodiment provides the gimbal ring formed as a gimbal assembly. The gimbal assembly utilizes a gimbal ring 15 positioned exterior to a gimbal support ring. The gimbal support ring and the gimbal ring are concentric, and connected by two opposing bridges. Preferably the gimbal assembly is constructed from spring steel.

Figure 9:
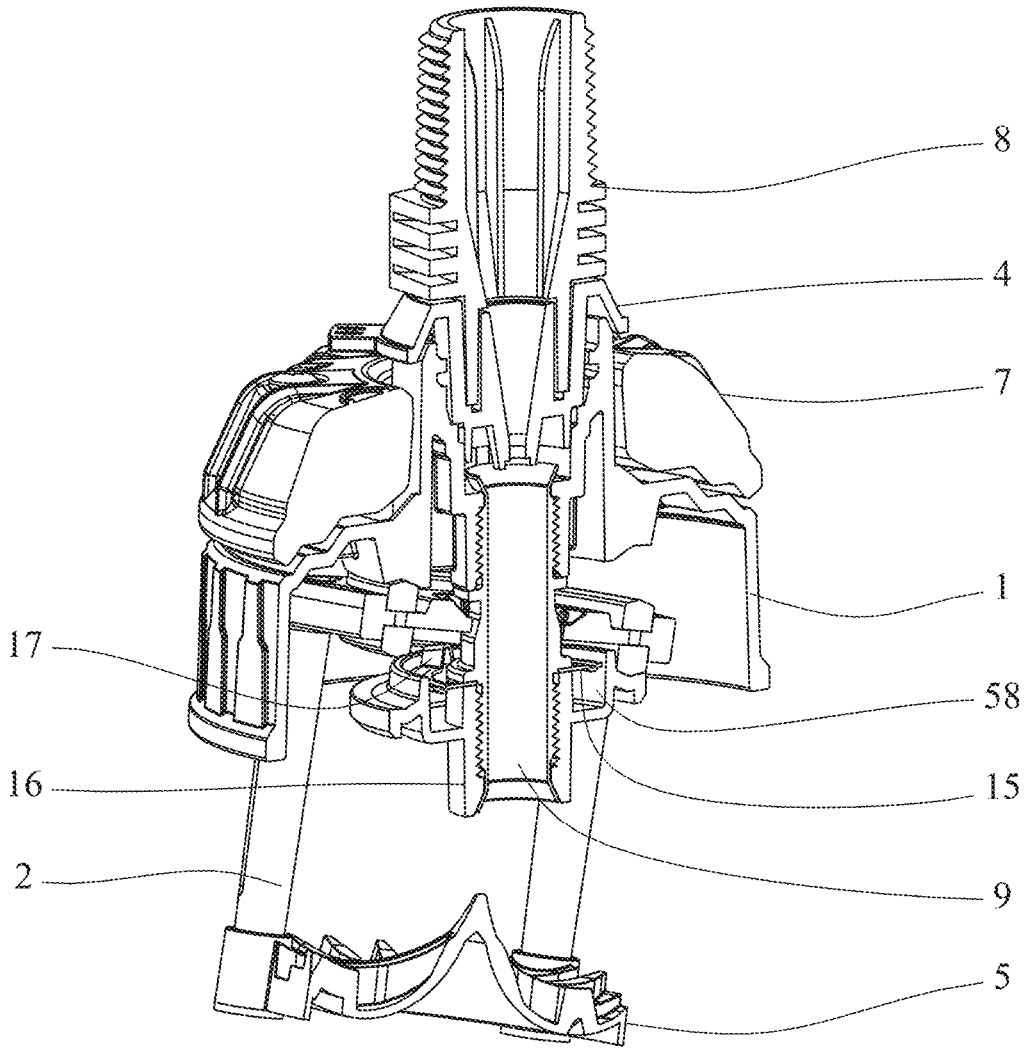
FIG. 9 is a perspective cross sectional view of an embodiment of a sprinkler head.

FIG. 9 illustrates a perspective cross sectional view of the second embodiment of the sprinkler head. The gimbal ring assembly 15 is illustrated in a void 58 within the lower sprinkler body ring.

Figure 10:
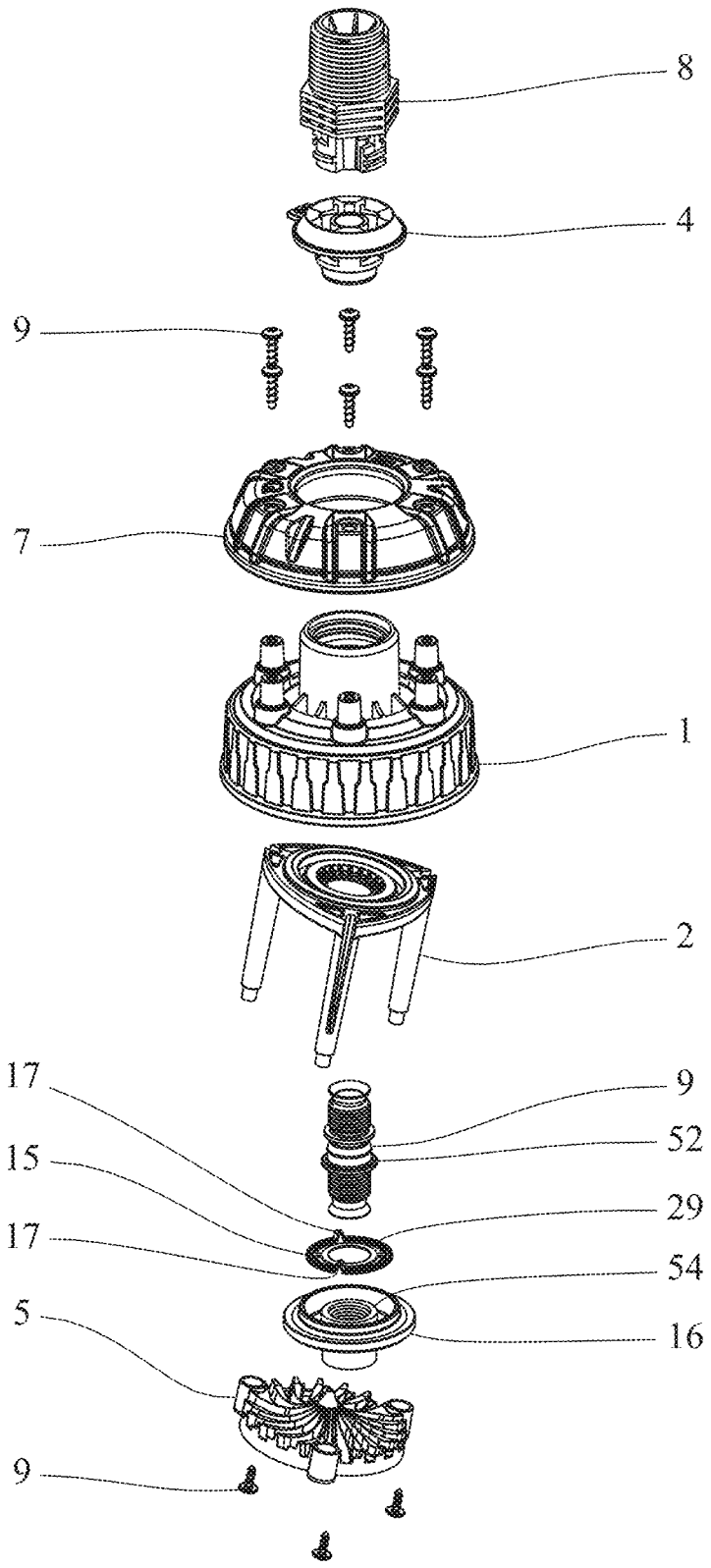
FIG. 10 is an exploded view of a second embodiment of a sprinkler head.

FIG. 10 illustrates an exploded view of the second embodiment of the sprinkler head. The fluid delivery tube 9 is illustrated with shoulder 52 provided compressive force onto the gimbal support ring 29 of the gimbal ring assembly. The gimbal ring 15 is provided with a projections 17 for providing tilt to the fluid distribution cage prior to initiation of nutation.

Figure 11:
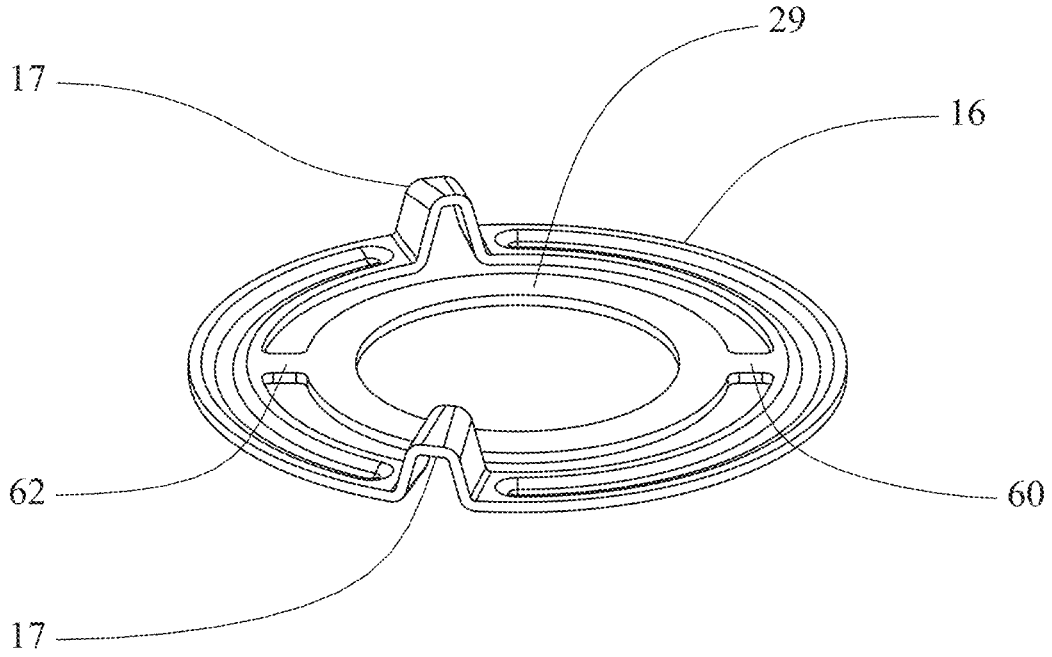
FIG. 11 is a perspective view of a gimbal ring assembly of a second embodiment of a sprinkler head. A gimbal ring assembly is provided on a shoulder 54 of the lower body ring and a shoulder 52 of a fluid delivery tube. The gimbal ring assembly in the depicted embodiment is a piece of spring steel provided with a pair of projections 17.

FIG. 11 shows a perspective view of the gimbal ring assembly of the second embodiment of the sprinkler head. The projections 17 extend upward from gimbal ring. Two opposing bridges 60, 62 extend between the gimbal ring 15 and the gimbal support ring 29. In assembly, the gimbal support ring is positioned between or sandwiched between the shoulders of the lower sprinkler body ring and the fluid delivery tube. In operation, the upper cage plate exerts force on one or the other projections 17. The force causes the gimbal ring to rotate downward at that projection. The bridges flex to allow the opposing side of the gimbal ring to travel upward. The spring construction of the gimbal assembly allows the gimbal ring 15 to return to level when pressure relieved from the projection 17. In the depicted embodiment, the gimbal ring 15 is provided with a reinforcement rib formed into it so that the gimbal ring does not bend as it rotates. This allows the bridges to twist and allows the gimbal ring to rotate about the axis defined by the opposing bridges of the gimbal ring. When the cage is running after initiation it clears the started bumps and recenters and allows the recentering of the gimbal ring.

While certain exemplary embodiments are shown in the Figures and described in this disclosure, it is to be distinctly understood that the presently disclosed inventive concept(s) is not limited thereto but may be variously embodied to practice within the scope of this disclosure. From the foregoing description, it will be apparent that various changes may be made without departing from the spirit and scope of the disclosure as defined herein.

What is claimed is:

1. A fluid distributing sprinkler head, comprising a fluid delivery tube with an attached fluid nozzle;

a sprinkler body upper plate attached to a lower end of said fluid delivery tube;

a fluid distribution cage freely attached to said fluid delivery tube lower end, said fluid distribution cage with a lower cage plate with a first and second side, and an upper cage plate with a first and second side, with said cage plates held in a spaced apart relationship by one or more cage arms;

a sprinkler body lower ring attached to a lower end of said fluid delivery tube, said sprinkler body lower ring comprising at least one raised projection extending upward from said sprinkler body lower ring, wherein said upper cage plate is configured to hang freely from said at least one raised projection when said cage is without fluid and said sprinkler head is in a vertical position, wherein said upper cage plate defining a passage for said fluid delivery tube lower end;

said lower cage plate first side having a peaked surface, said surface incised by spirally radiating grooves with a peak on said lower plate first side centrally positioned and having a beveled top surface;

wherein said beveled top surface on said lower plate configured for deflection by an initial jet of fluid from said fluid delivery tube, to initiate a nutating motion in said cage after said initial deflection with said nutating motion maintained by the force of fluid on said spirally radiating grooves causing said upper cage plate to nutate between said sprinkler body upper plate and said sprinkler body lower plate, wherein said at least one raised projection is configured to move downward out of a path of nutation of said upper cage plate when said upper cage plate contacts said at least one raised projection during initiation of nutation of said upper cage plate.

2. The sprinkler head of claim 1, wherein said sprinkler body lower ring comprises a gimbal ring positioned within said sprinkler body lower ring, wherein said at least one raised projection is positioned on an upper surface of said gimbal ring, wherein said gimbal ring is configured to rotate relative to said sprinkler body lower ring when said upper cage plate contacts said raised projection when said upper cage plate is nutating.

3. The sprinkler head of claim 2, wherein said at least one raised projection comprises at least two raised projections positioned on rotationally opposite sides of said gimbal ring.

4. The sprinkler head of claim 2, wherein said gimbal ring comprises two opposing gimbal axles, wherein said gimbal axles are positioned within bearing bosses of an internal circumference of said sprinkler body lower ring.

5. The sprinkler head of claim 4, wherein said gimbal ring is configured to prevent said gimbal axles from dislodging from said bearing bosses during nutation of said upper cage plate.

6. The sprinkler head of claim 5, wherein said gimbal ring comprises at least one lower projection extending from a bottom of said gimbal ring, wherein said lower projection is configured to prevent said gimbal axles from dislodging from said bearing bosses during nutation of said upper cage plate.

7. The sprinkler head of claim 6, wherein said sprinkler body lower ring comprises an internal opening comprising a lip, wherein said lower projection is configured as a hook such that said hook is configured to contact said lip to prevent said gimbal from rotating such that said gimbal axles are dislodged from said bearing bosses.

8. The sprinkler head of claim 2, wherein said gimbal ring is connected to a gimbal support ring positioned interior to said gimbal ring by a pair of opposing bridges, wherein contact by said upper cage plate onto said at least one projection causes said gimbal ring to rotate about an axis defined by said pair of opposing bridges.

9. The sprinkler head of claim 8, wherein said gimbal ring connected to said gimbal support ring and said pair of opposing bridges, comprise a gimbal assembly, wherein said gimbal assembly comprises spring steel.

10. The sprinkler head of claim 8, wherein said lower sprinkler body ring defines a lower sprinkler body shoulder, wherein said gimbal support ring is positioned on said lower sprinkler body shoulder.

11. The sprinkler head of claim 10, wherein said fluid distribution tube defines a fluid distribution tube shoulder, wherein said gimbal support ring is positioned between said lower sprinkler body shoulder and said fluid distribution tube shoulder.

* * * * *